US008881736B2

(12) United States Patent
Hatcher et al.

(10) Patent No.: US 8,881,736 B2
(45) Date of Patent: Nov. 11, 2014

(54) CIGAR HOLDER ASSEMBLY

(71) Applicants: Brenda Gail Hatcher, Hartselle, AL (US); John Dominick DeRosa, Damascus, MD (US); Maria DeRosa, Damascus, MD (US)

(72) Inventors: Brenda Gail Hatcher, Hartselle, AL (US); John Dominick DeRosa, Damascus, MD (US); Maria DeRosa, Damascus, MD (US)

( * ) Notice: Subject to any disclaimer, the term of this patent is extended or adjusted under 35 U.S.C. 154(b) by 0 days.

(21) Appl. No.: 13/708,956

(22) Filed: Dec. 8, 2012

(65) Prior Publication Data

US 2013/0146071 A1 Jun. 13, 2013

Related U.S. Application Data

(60) Provisional application No. 61/568,223, filed on Dec. 8, 2011.

(51) Int. Cl.
*A24F 13/08* (2006.01)

(52) U.S. Cl.
CPC ..... *A24F 13/08* (2013.01)
USPC ..... 131/260; 131/190

(58) Field of Classification Search
USPC ..... 131/187–190, 257–260; 24/278–280, 24/284, 349, 489, 505, 514; 248/229.13–229.14, 229.23–229.24, 248/230.4–230.5
See application file for complete search history.

(56) References Cited

U.S. PATENT DOCUMENTS

| | | | | |
|---|---|---|---|---|
| 3,756,252 | A * | 9/1973 | Vigorito | 131/256 |
| 5,868,143 | A * | 2/1999 | Nielsen | 131/329 |
| 2008/0104805 | A1* | 5/2008 | Cameron | 24/346 |
| 2009/0032035 | A1 | 2/2009 | Thorpe | |
| 2009/0151137 | A1* | 6/2009 | Darling, III | 24/568 |
| 2009/0183742 | A1 | 7/2009 | Strasheim | |
| 2010/0302655 | A1* | 12/2010 | Hill | 359/818 |
| 2011/0253154 | A1 | 10/2011 | Dolciato | |

FOREIGN PATENT DOCUMENTS

| | | |
|---|---|---|
| FR | 2816173 A | 5/2002 |
| WO | 2008055075 A | 5/2008 |

* cited by examiner

*Primary Examiner* — Richard Crispino
*Assistant Examiner* — Eric Yaary
(74) *Attorney, Agent, or Firm* — The Law Firm of Andrea Hence Evans, LLC

(57) ABSTRACT

The invention features a two-piece holder which features an expandable opening sized to receive and support numerous size cigars. The opening features ridge cuts that aid in holding a cigar in its desired position. The handle of the holder affords the user the opportunity to smoke the body of the cigar to the fullest possible extent without burning the smoker's fingers.

14 Claims, 3 Drawing Sheets

CIGAR HOLDER ASSEMBLY

RELATED U.S. APPLICATION DATA

This application claims the benefit of provisional application No. 61/568,223, filed Dec. 8, 2011 and is hereby incorporated by reference in its entirety.

FIELD OF THE INVENTION

The present invention relates, in general, to a holder for supporting a smoking article such as a cigar, and more specifically to an expandable holder adapted to hold different size cigars in use.

BACKGROUND OF THE INVENTION

Cigars have long been associated with rich and powerful people as well as associated with relaxation, sophisticated pleasure, rich flavor, and the conversation of good friends. They are highly collectible and they can be extremely expensive. Improper handling of a cigar causes unraveling of the wrapper and could even damage the binder and filler tobacco inside. There is an art to smoking cigars. If smoked too fast, it will burn hot and ruin the flavor. If smoked too slow, it will go out and will require constant relighting. Cigar smokers prefer to smoke as much of the cigar as they can. However, their fingers can be burned if they are holding the cigar and it is too small. Thus, a smokeable portion of the cigar is wasted.

SUMMARY OF THE INVENTION

The present invention provides a cigar holder that affords the user the benefit of smoking a cigar as far down as they desire so that the taste and flavor of a good cigar can be enjoyed and appreciated.

An aspect of an embodiment of the invention provides an expandable cigar holder assembly adapted to hold different sizes of cigars.

A further aspect of an embodiment of the invention features the cigar holder assembly having an adjustable screw clamp which is spring loaded.

A further aspect of an embodiment of the invention features a top with ridged or cut areas which aid in holding the cigar in place.

Additional aspects, objectives, features and advantages of the present invention will become apparent from the following description of the preferred embodiments with reference to the attached drawings.

DETAILED DESCRIPTION OF THE INVENTION

Figure 1:
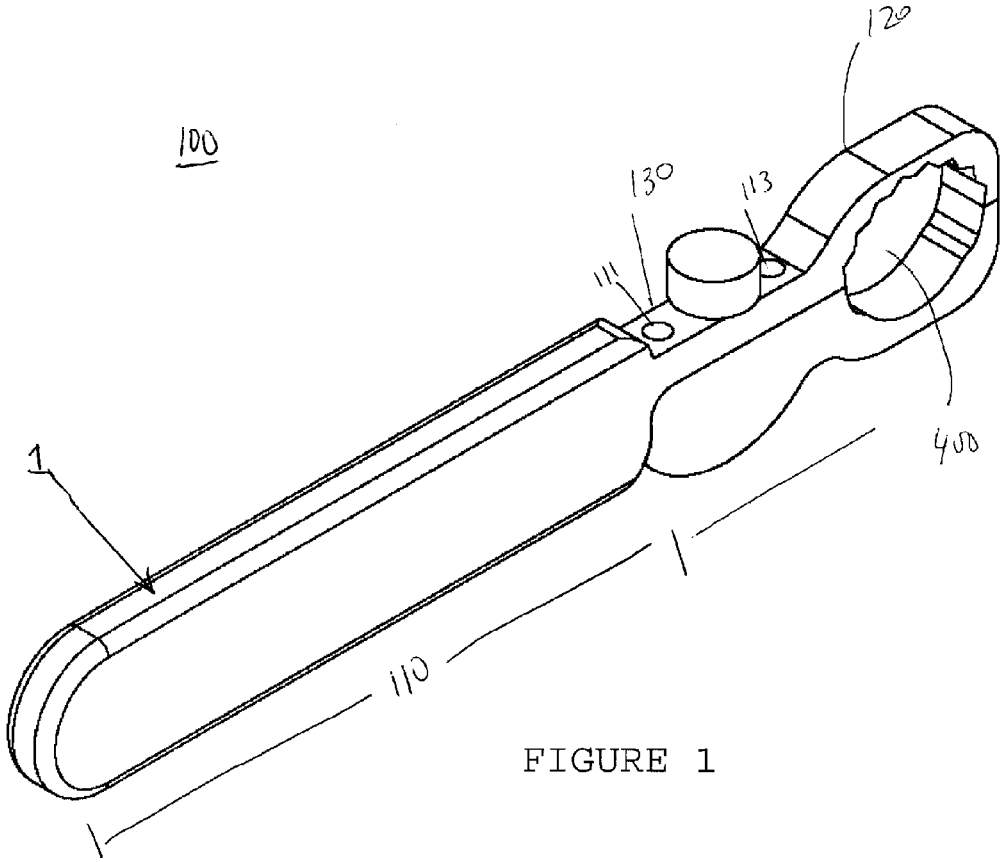
FIG. 1 illustrates an assembled view of the holder of the present invention.
Figure 2:
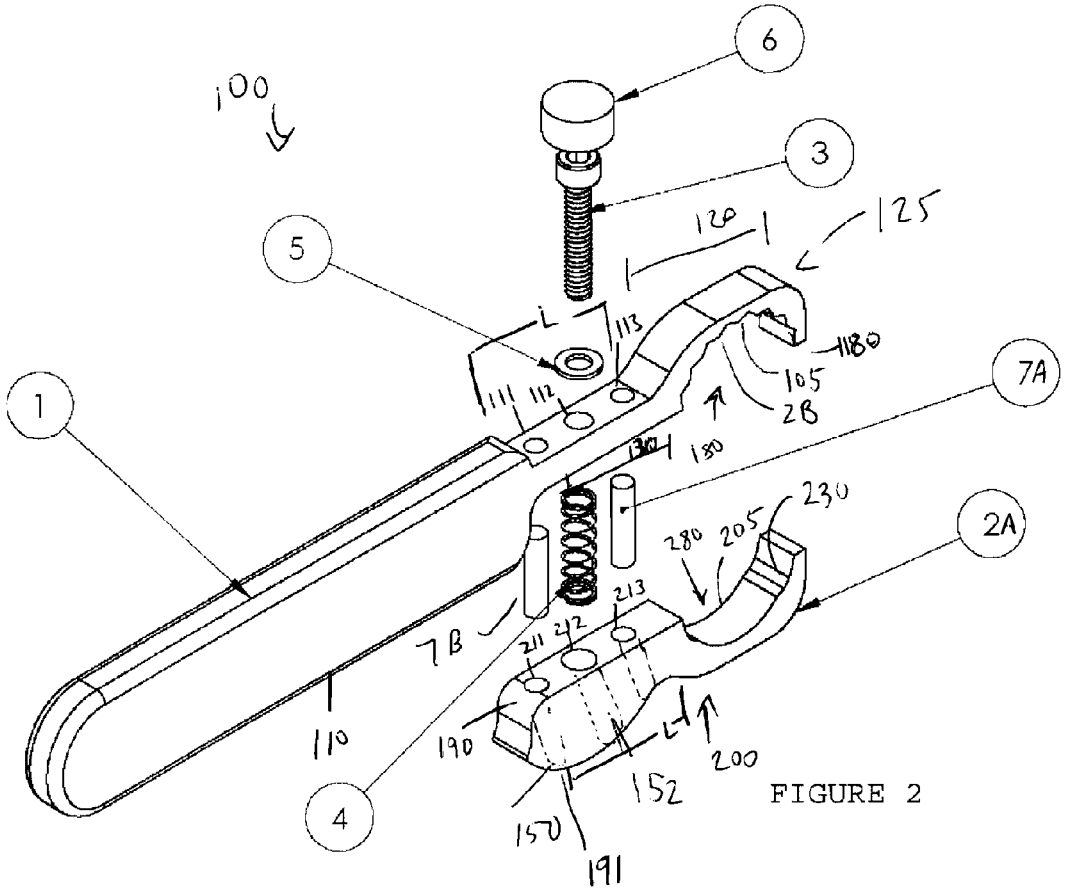
FIG. 2 illustrates an exploded view of the holder of the present invention.

FIG. 1 illustrates an assembled view of the holder assembly 100 of the present invention. The holder assembly features a shaft 1 acting as a handle having a first end 110 that is grasped by the user or an alternative support. The shaft 1 has a first end 110, middle area 130 and second end 120. The support can be an object that is not the user's body part. Holding the shaft 1 on the first end 110 allows the user to avoid being burned while smoking the cigar to the fullest possible extent. The handle 1 is a preferably an oblong shape, however, alternate shapes may be used provided the user can get a good grip on the handle 1. The handle 1 may be personalized with the users name or other symbols, images or designs. Also, the handle may be multiple colors. The holder assembly 100 may be made from a stainless steel or aluminum material. Alternative durable and lightweight materials may be used to make the holder assembly. A second end 120 of the handle 1 features a middle area 130 having holes or openings 111, 112, 113, as shown in FIG. 2. At least three holes 111, 112, 113 are featured on the middle section 130 of the handle. The holes 111, 112, 113 are circular openings that extend from the top surface of the middle area to the bottom surface of the middle area. The holes 111, 112 and 113 are circular to receive circular screws or pins. However, the shape of the holes may be modified to receive alternate shaped screws and pins. The first 111 and third holes 113 have a diameter slightly smaller than the diameter of a first 7A and second dowel pin 7B such that the dowel pins 7A and 7B can be pressed into the holes 111 and 113, as illustrated in FIG. 2 to secure the dowel pins to the shaft.

FIG. 2 illustrates an exploded view of the holder assembly 100 of the present invention. The pins 7A and 7B connect the middle area 130 of the handle 1 with the arm 150 of the second gripping element 200. The second gripping element 200 features three holes 211, 212, and 213 that are aligned with the three holes 111, 112, and 113 of the middle area 130 of the shaft 1. The holes 211, 212 and 213 on the second gripping element 200 are channels that receive the bodies of the dowels 7A, 7B, spring 4 and thumb screw 3. Dowels 7B, 7A are positioned in the first hole 111 and third hole 113 of the middle area holes and then received by the first 211 and third channels 213 of the second gripping member 200. The dowel pins 7A and 7B ensure accurate alignment between the middle area 130 of the shaft and the second gripping element arm 150. The pins 7A and 7B are inserted into holes 211 and 213 in the arm 150 and holds the shaft 1 and second gripping element 200 together. A screw 3 having a washer 5 positioned between the screw 3 and top of the second hole 112 on the middle area 130 of the handle 1 is positioned through a compression spring 4 and then both the screw 3 and spring 4 are received by the second threaded hole/channel 212 on the second gripping element 200. The washer 5 is used to distribute the load of the screw 3. The washer 5 may be metal or durable plastic or an alternate material that can withstand the force of the screw 3. Alternatively, the screw 3 may be replaced with an alternate threaded fastener. The screw 3 is spring loaded. The spring 4 further distributes the load of the screw 3 and also helps to maintain the screw in position. The spring 4 is positioned inside the channel 212 of the arm 150 of the second gripping element 200. The spring's diameter is slightly smaller than the diameter of the channel 212 so the channel 212 can receive the spring 4.

The dowels 7A, 7B, screw 3 and spring 4 are concealed by the channels 211-213 and body 152 of the second gripping element 200. The body 152 of the second gripping element 200 includes the arm 150 having a length L that is at least the length L of the middle area 130. The lengths are the same to ensure proper alignment of the arm 150 and the middle area 130. The body 152 extends downward from the top 190 of the arm 150 to the bottom 191 forming a semi-circular shaped body. The body shape may be modified to alternate shapes so long at the shapes are a depth that is deep enough to receive and conceal the screws and pins. The body can be multiple or solid colors and may also be transparent if it is desired to see the screws and pins.

A cap 6 is positioned on the top of the screw 3 and is used to turn the screw to expand and retract the second gripping member 200 and upper front portion 125 of the handle 1 where the first gripping member 120 is located. The cap 6 makes it easier to turn the screw in a clockwise or counter-clockwise direction. The first gripping member 120 and the second gripping member 200 are inverted U or C-shaped jaws 180, 280. The second gripping element 200 jaw 280 has a smooth top side 205. First gripping element 120 has a ridged and cut underside 105. The ridged and cut underside 105 have peaks and valleys that form angles that aid in holding the smoking article such as a cigar in position when placed in the holder assembly 100. The second gripping member 200 features a body 152 having three channels 211, 212 and 213, as described above, and a smooth curved front area 205. The ridged and cut underside 105 aligns with the smooth curved front area 205 of the second gripping member such that, when the handle 1 and second gripping member 200 are connected, an opening 400, shown in FIG. 1, is formed which receives a smoking article such as cigar. The ridges and cuts 105, shown in FIG. 2, on the handle 1 and the smooth curved front area 205 make contact with the cigar, along with the inside curved right sides 1180 and 230 of the gripping members jaws 180, 280, respectively. The holder assembly 100 allows the cigar to be securely held in place while smoking and affords the smoker the ability to smoke the cigar to the fullest possible extent without burning the smoker's fingers. Alternatively, the ridges and cuts on the underside of the handle may be smoothed and the smooth area on the curved front area may be ridged or cut. Alternatively, both surfaces may be smooth or both may have cuts. Preferably, one gripping member has cuts and the other smooth to properly grip the smoking article and avoid it slipping or falling out of the holder assembly.

Figure 3:
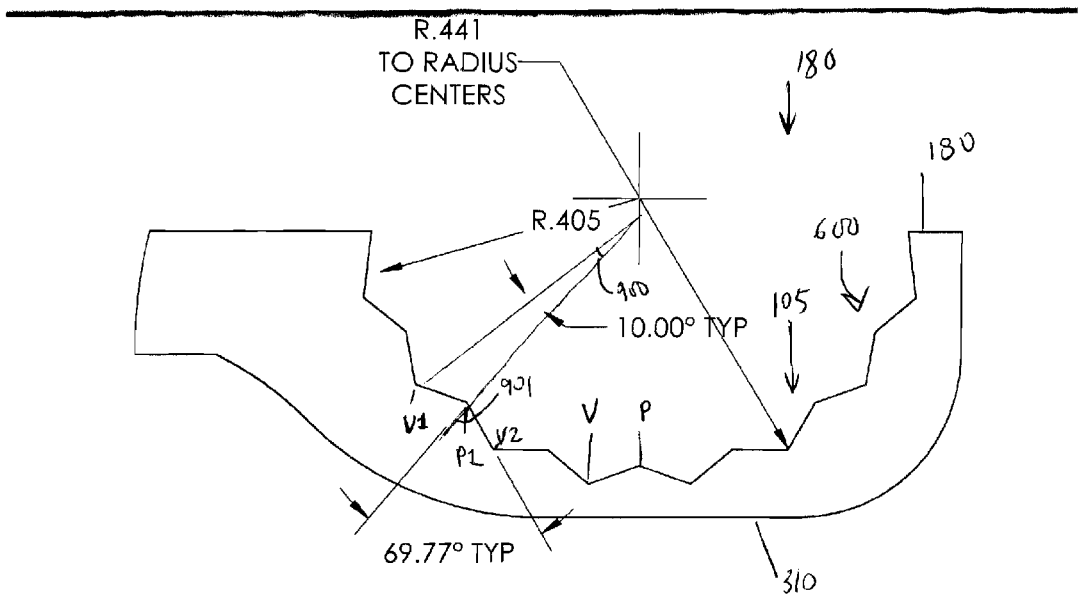
FIG. 3 illustrates a gripping element jaw of the shaft of the present invention.

FIG. 3 illustrates a gripping element jaw 180 of the shaft 1 of the present invention. The jaw 180 features a curved top side 310. The curved shaped is somewhat of a wide C or U-shaped. The bottom inside surface 600 of the jaw 180 have ridged and cut undersides 105. The ridged and cut undersides 105 have peaks P and valleys V that form teeth that aid in holding the smoking article such as a cigar in position when placed in the holder assembly 100. The peaks P and valleys V grip the smoking article and secure it in place when in the assembly 100. When the first gripping element 120 jaws 180 and second gripping element jaws 230 are positioned so that the first jaw 180 inside surface 600 faces the inside surface 205 of the second gripping element, an opening 400, shown in FIG. 1, is formed. The jaws 180, 280 expand or retract to adjust to the diameter of the smoking article. The angle 900 formed between the valley V1 and peak P1 is about 10 degrees from the radius of this opening 400 along the bottom inside 600. The angle 901 formed between the peak P1 and valley V2 from the perspective of the bottom inside 600 to the top surface 310 is about 69.77 degrees.

To position the smoking article, such as a cigar, in the holder assembly 100, rotate the screw 3 by turning the attached cap 6 or the screw 3 directly in counter clockwise direction which the handle 1 to move apart or expand away from the second gripping member 200. This increases the size of the opening 400 formed between the first gripping member 120 at upper front portion of the shaft and the second gripping member 200 to accommodate smoking articles of various sizes. The cigar is placed in the opening 400 and the screw is rotated in a clockwise direction to move the second gripping member 200 towards the first gripping member 120 to securely hold the cigar such that there is little or no room for movement of the cigar in the holder assembly 100. The entire shaft which includes the first end 110, middle area 130 and second end 120 moves towards the entire second member 200 as the second member 200 moves towards the shaft, when the screw is rotated clockwise. Similarly, the entire shaft 1 which includes the first end 110, middle area 130 and second end 120 moves away from the entire second member 200 as the second member 200 moves away from the shaft, when the screw is rotated counterclockwise. The entire shaft and the second gripping member 200 maintain a parallel direction in relation to each other when the first gripping member 100 and the second gripping member 200 retract and expand. As the shaft 1 and second gripping member 200 moves away from each other, the screw 3 and dowel pins 7A and 7B become more visible. As the shaft 1 and second gripping member 200 move towards each other, the screw 3 and dowel pins 7A and 7B become less visible, since they are moved further inside of their respective channels 211, 212, 213. The curved C-shaped or U-shaped jaws 180, 280 and the curved right sides 1180 and 230 wrap around an entire body of the cylindrical smoking article.

The holder assembly 100 is handled by its first end 110 and the user can enjoy a cigar more of a smokeable portion of a cigar than they would if the cigar was smoked directly in the user's hand. The assembly 100 prevents burning of the user's hands and allows more of the cigar to be smoked than would normally be smoked if handheld. The handle of the holder affords the user the opportunity to smoke the body of the cigar to the fullest possible extent without being burned.

The invention has been described in detail with particular reference to certain preferred embodiments thereof, but it will be understood that variations and modifications can be effected within the spirit and scope of the invention.

The invention claimed is:

1. A holder assembly for a smoking article comprising: a shaft having a unitary first end, middle area and second end; a plurality of holes on the middle area; wherein the second end of the shaft is a first gripping element; a second gripping element having an arm with a length of the middle area of the shaft and extending from the second gripping element; wherein the arm features channels that align with the plurality of holes on the middle area of the handle; a screw received by one hole in the middle area of the shaft and a channel in the second gripping element to connect the shaft to the second gripping element; a spring inside of the channel that receives the screw; pins received in the remaining holes and aligned channels that connect the middle area of the shaft to the arm of the second gripping element providing the entire shaft and second gripping element to maintain a parallel direction in relation to each other when the first gripping element and the second gripping element retract and expand.

2. The holder assembly for the smoking article of claim 1, wherein the first gripping element is a curved arm with cuts on its underside.

3. The holder assembly for the smoking article of claim 1, wherein the second gripping element is a curved arm with a smooth underside.

4. The holder assembly for the smoking article of claim 1, wherein the arm of the second gripping element further comprises a body that conceals the at least one channel and the screw.

5. The holder assembly for the smoking article of claim wherein the first gripping element and second gripping element engage and form an opening adjustable in site to support the smoking article.

6. The holder assembly for the smoking article of claim 1 further comprising a cap on the top of the screw.

7. A holder assembly for a smoking article comprising: a shaft having a first end, middle area and second end; at least three holes on the middle area featuring a first, second and third hole; wherein the second end of the shaft is a first gripping element; a second gripping element having an arm extending from the second gripping element, wherein the arm is at least the length of the middle area of the shaft and the arm features at least three channels featuring a first, second and third channel that align with the at least three holes on the middle area of the handle; a screw received by the second hole and respective second channel to attach the middle area of the shaft and the arm of the second gripping element; a spring inside of the channel that receives the screw; and pins received by the first and third holes and respective first and third channels, wherein the screw is positioned between the pins and wherein the first gripping element and second gripping element and connected shaft and second gripping element retract and expand by turning the screw while maintaining a parallel direction in relation to each other.

8. The holder assembly for the smoking article of claim 7, wherein the first gripping element and second gripping element are C-shaped or U-shaped and wrap around an entire body of the smoking article.

9. The holder assembly for the smoking article of claim 7, wherein the arm of the second gripping element further comprises a body having a depth at least the length of the at least three channels.

10. The holder assembly for the smoking article of claim 7, further comprising a pin received by one of at the least three holes on the middle area and one of the at least three channels aligned.

11. The holder assembly for the smoking article of claim 7, wherein the first gripping element and second gripping element engage and form an opening adjustable in size by turning the screw to support the smoking article.

12. The holder assembly for the smoking article of claim 11, wherein the opening expands when the screw is turned in a counter clockwise direction.

13. The holder assembly for the smoking article of claim 11, wherein the opening retracts when the screw is turned in a clockwise direction.

14. The holder assembly for a smoking article of claim 1 wherein the first gripping element and second gripping element form an opening that retracts and expands to adjust to the diameter of the smoking article when the screw is turned.

* * * * *